US005423294A

United States Patent [19]

Cole et al.

[11] Patent Number: 5,423,294

[45] Date of Patent: Jun. 13, 1995

[54] FURNACE TILE AND EXPANSION JOINT

[75] Inventors: Arthur W. Cole, Rowley, Mass.; Franklin A. Hamlyn, Hampton, N.H.; James D. Dougherty, Stamford, Conn.; John M. O'Sullivan, Stony Point, N.Y.

[73] Assignee: Wheelabrator Environmental Systems, Inc., Hampton, N.H.

[21] Appl. No.: 160,875

[22] Filed: Dec. 3, 1993

[51] Int. Cl.[6] ..... F22B 17/02; F28F 19/00

[52] U.S. Cl. ..... 122/512; 122/DIG. 13; 165/134.1

[58] Field of Search ..... 122/6 A, 512, 235 A, 122/DIG. 13, DIG. 14; 165/134.1

[56] References Cited

U.S. PATENT DOCUMENTS

| | | | |
|---|---|---|---|
| 4,619,314 | 10/1986 | Shimoda | 165/134.1 |
| 4,682,568 | 7/1987 | Green et al. | 122/DIG. 13 |
| 4,934,322 | 6/1990 | Fournier et al. | 122/DIG. 13 |
| 5,092,278 | 3/1992 | Gold et al. | 122/512 |
| 5,094,292 | 3/1992 | Buckshaw | 122/DIG. 13 |
| 5,154,139 | 10/1992 | Johnson | 122/512 |
| 5,154,648 | 10/1992 | Buckshaw | 122/DIG. 13 |
| 5,220,957 | 6/1993 | Hance | 122/DIG. 13 |

*Primary Examiner*—Henry C. Yuen
*Assistant Examiner*—Weilun Lo
*Attorney, Agent, or Firm*—Banner, Birch, McKie & Beckett

[57] ABSTRACT

A protective wall structure for protecting boiler tubing in facilities using refuse as a fuel source to produce steam for electrical power generation. The protective wall structure includes an array of shielding tiles, heat transfer bonding material, and elongated compressible material. The shielding tiles include a front surface facing the interior combustion zone of the facility, a rear surface facing the boiler tubes, and a plurality of sidewall surfaces. The heat transfer bonding material is positioned between the boiler tubes and the rear surfaces of the shielding tiles to permit heat transfer and create a bond between the boiler tubes and the shielding tiles. The elongated compressible material is positioned between the sidewall perimeter surfaces of adjacent shielding tiles to provide an expansion joint. This permits relative expansion between adjacent shielding tiles without cracking upon an increase in temperature in the interior combustion zone.

12 Claims, 8 Drawing Sheets

FURNACE TILE AND EXPANSION JOINT

FIELD OF THE INVENTION

The present invention relates to a protective wall structure for protecting boiler tubing in furnaces of steam generating units. More specifically, the present invention relates to a refractory tile and expansion joint arrangement used for protecting boiler tubes in facilities using refuse as a fuel source to produce steam for electrical power generation.

BACKGROUND OF THE INVENTION

Combustive products from municipal refuse can be very corrosive. During the operation of refuse-to-energy facilities, it is important to protect boiler tubes from corrosion. Corroded boiler tubes can leak which reduces the facility efficiency and frequently leads to the premature shut-down of the facility. Prior facilities provided arrangements to protect boiler tubes, however, these arrangements have been costly and have not been proven to be effective in protecting boiler tubes over prolonged periods of time.

The need to provide environmentally correct and cost effective solutions for the refuse generated in the Unites States became apparent in the late 1960's. At that time, refuse disposal was mainly by land filling and to a lesser extent incineration. That situation changed as landfill space became recognized as a finite resource and that refuse could be used as a fuel source which could displace other, more costly, fuel sources in the generation of process steam and electricity. Refuse-to-energy plants became a common source of energy.

A common refuse-to-energy facility, generally indicated by reference numeral 2, is shown in FIGS. 1–3. In operation, a crane or a front end loader (not shown) picks up a quantity of refuse from a refuse storage area and deposits it into charging hopper 4. Charging hopper 4 has a large plan area to facilitate this operation and acts as a funnel to feed the refuse to feed chute 6. Refuse travels down feed chute 6 by gravity until it reaches ram table 8 at the bottom of feed chute 6. Ram feeder 10 pushes refuse from ram table 8 horizontally onto reciprocating grates 12 for incineration in combustion zone 14 of furnace 16.

As depicted in FIG. 2, combustion zone 14 or the lower furnace environment is bounded by furnace walls 18 which include a plurality of horizontally spaced boiler tubes 20 and tube joining members or membranes 22 which structurally join adjacent boiler tubes 20 to one another. Boiler tubes 20 carry cooling water to recover the heat given off from the burning of refuse in combustion zone 14.

As previously described, boiler tubes 20 are subject to corrosion due to the corrosive constituents in refuse, which may include sodium, sulfur, potassium, vanadium, chloride, lead and zinc. Further, combustion zone 14 is constantly changing between an oxidating atmosphere (an excess of $O_2$ beyond that need for combustion) and a reducing atmosphere (a deficiency of $O_2$ below that needed for combustion) which can rapidly accelerate corrosion. Therefore, some form of corrosion protection is need.

Experience has dictated that boiler tube protection for at least the furnace front wall and the side walls is required up to a height of about thirty feet above the grate surface where there is reasonable assurance that oxidation zones are predominant. In a typical arrangement, the lowest part 21 of the protective wall structure, usually the bottom three feet, is comprised of thick refractory firebricks. This is necessary in this area 21 to protect the boiler tubes from the intense local combustion temperatures and corrosive gases. As previously mentioned, prior art protective wall structures used to protect the boiler tubes in the area 23 above the thick firebrick to a height of about thirty feet have been costly and unreliable and have exhibited a relatively short useful life.

While protective structure for the boiler tubes in area 23 is necessary to prevent costly tube failures, it is equally important that the protective structure have a high thermal conductivity rate. A protective structure with a low thermal conductivity rate reduces the effectiveness of the water-cooled surface it is protecting by preventing the heat given off from the refuse combustion to reach the boiler tubes. Therefore, it would be desirable to have a protective wall structure in area 23 for preventing the boiler tubes which is inexpensive, reliable and which has a high thermal conductivity rate.

A prior art design of a furnace wall protective arrangement 24 is conveniently described with reference to FIG. 4. Furnace wall 26 includes boiler tubes 28 with a large quantity of pin studs 30 attached thereto and membranes 32 which join adjacent boiler tubes 28. A sprayed on or hand troweled castible refractory 34, typically a silicon carbide refractory, is applied to the interior of furnace wall 26 to protect boiler tubes 28. Pin studs 30 increase the heat transfer between furnace interior 36 and enhance the mechanical bond between boiler tubes 28 and castible refractory 34.

One drawback of arrangement 24 is that refractory 34 has proved to be an insulator against heat transfer. Further, refractory 34 has been susceptible to breaking or chipping, a.k.a. spalling, mostly due to the mechanical pressure associated with thermal expansion and contraction. If the refractory spalls during operation, boiler tubes 28 are left unprotected from the gases and the flames in combustion zone 14. Unprotected boiler tubes exposed to combustion zone 14 corrode and leak, frequently leading to the premature shut-down of the entire unit for repair.

Another drawback of arrangement 24 is that refractory 34 must be properly applied and cured during installation to achieve its expected quality and physical characteristics. A lack of quality control during the refractory installation will result in a lower quality protective refractory. A lower quality refractory leads to accelerated spalling and deterioration, and thus also leads to accelerated tube failure. Therefore, to properly apply refractory 34 and achieve its desired characteristics, a high quality control over refractory installation is required. This required quality control increases the installation cost of the protective wall structure.

An additional drawback associated with arrangement 24 is that it requires pin studs 30 to create the required mechanical bond to refractory 34. The use of pin studs 30 on boiler tubes 28 increases installation and product costs over units having boiler tubes without studs.

In another prior art design, not shown, relatively thin silicon carbide tiles are used in lieu of the castible material. The tiles are attached to the boiler tubes by a layer of mortar. Mortar is also used to fill the small gaps between adjacent tiles. However, because of the thermal expansion which occurs when the furnace is brought up on line after being taken down for an outage, adjacent tiles expand into each other, crack, and subsequently fall off the wall. The fallen tiles leave the boiler tubes immediately therebehind exposed to, and unprotected from, the furnace interior environment. As previously mentioned, unprotected boiler tubes exposed to the furnace interior corrode and leak.

Therefore, it would be desirable to have a boiler tube wall protective structure that would serve the dual functions of heat transfer and protection from conditions found in the combustion zone of the furnace. Further, it would be desirable to have a long-lasting boiler tube wall protective structure which prevents unscheduled facility outages due to boiler tube failure and does not require frequent repair.

SUMMARY OF THE INVENTION

It is an objective of the invention to provide a protective wall structure for boiler tubes that is resistant to the physical and temperature conditions found in the combustion zone of furnaces to extend the required maintenance cycle beyond that of existing protective wall structures.

It is another objective of the present invention to provide a protective wall structure that efficiently protects boiler tubes from intense local combustion temperatures with efficient heat transfer characteristics.

It is a further objective of the invention to provide a sidewall structure that does not require studs on the boiler tubes which increase assembly and product costs.

In accordance with these objectives and others that will become apparent from the description herein, the invention provides a protective wall structure for protecting boiler tubes in a furnace. The protective wall structure comprises an array of shielding tiles, heat transfer bonding material, and elongated compressible material. The shielding tiles include a front surface facing the interior combustion zone, a rear surface facing the boiler tubes, and a plurality of sidewall surfaces around the perimeter thereof. The heat transfer bonding material is positioned between the boiler tubes and the rear surfaces of the shielding tiles to permit heat transfer and create a bond between the boiler tubes and the shielding tiles. The elongated compressible material is positioned between the sidewall perimeter surfaces of adjacent shielding tiles and permits relative expansion between the adjacent shielding tiles due to an increase in temperature in the furnace.

DETAILED DESCRIPTION

Figure 5:
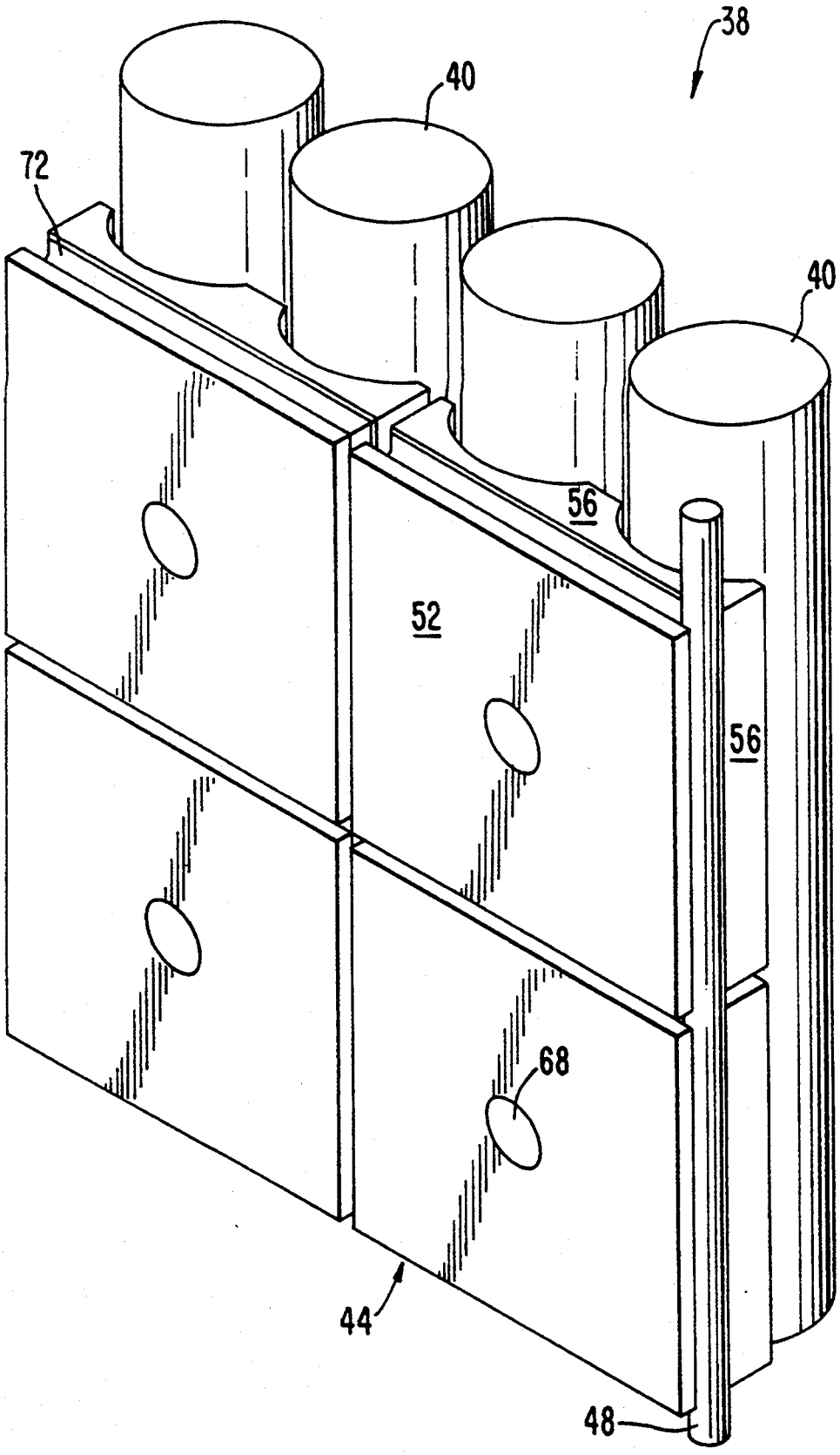
FIG. 5 depicts a perspective view of a section of the furnace wall and protective structure of the present invention.
Figure 6:
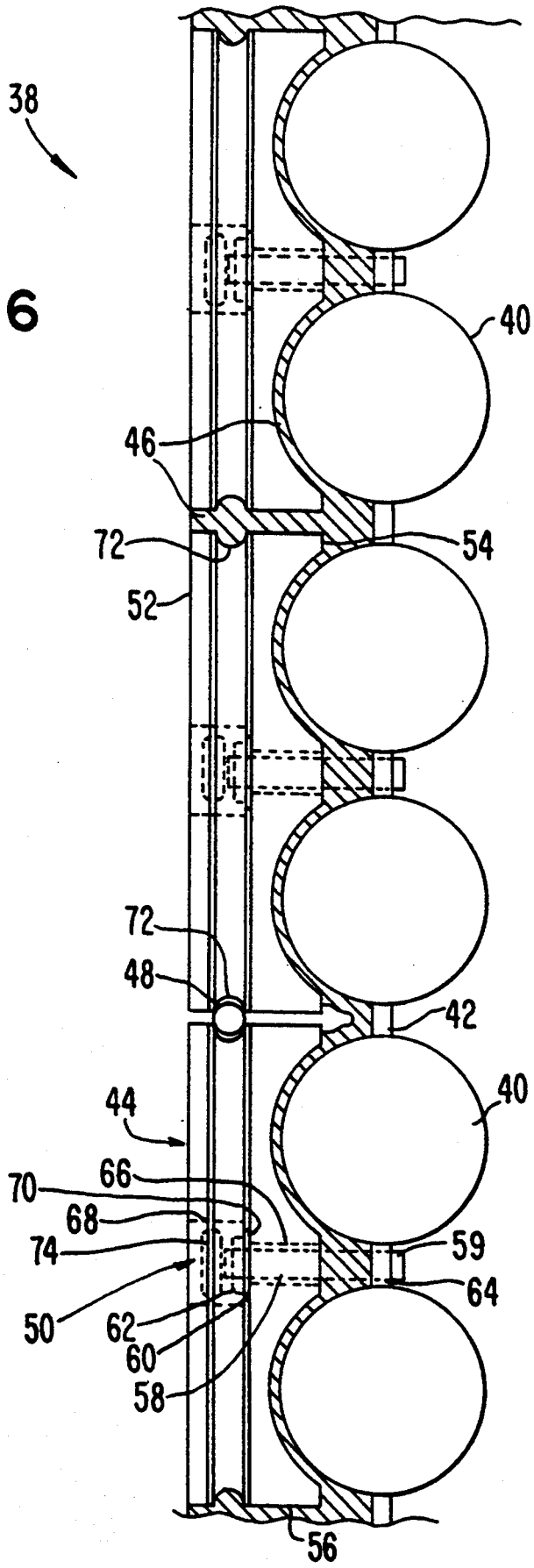
FIG. 6 is a top sectional view of the furnace wall and protective structure of the present invention.

A preferred protective wall structure for protecting boiler tubes in steam generating facilities is best shown in FIGS. 5 and 6 and is indicated generally by reference numeral 38. As in the previously described prior art, the furnace walls are comprised of boiler tubes 40 and membranes 42. Membranes 42 join adjacent boiler tubes 40 to form a complete wall. Protective wall structure 38 protects boiler tubes 40 in furnace walls, most ideally in furnace side walls, in the areas from approximately three feet to thirty feet above the reciprocating grates.

Protective wall structure 38 includes an array of shielding tiles 44, heat transfer bonding material 46, and elongated compressible material 48. Shielding tiles 44 are preferably square and include a generally planar front surface 52, a rear surface 54 which is contoured to approximate the furnace wall therebehind, and side or perimeter surfaces 56 at the top, bottom and left and right sides.

Shielding tiles 44 are attached to the furnace wall by mounting hardware 50 and heat transfer bonding material 46. Heat transfer bonding material 46 includes adhesive properties to help bond shielding tiles 44 to boiler pipes 40. In addition, heat transfer bonding material 46 has a high coefficient of thermal conductivity and fills the gaps between shielding tile 44 and pipes 40. This enhances the heat transfer between combustion zone 14 and boiler pipes 40.

Mounting hardware 50 which is used to attach each shielding tile 44 to the furnace wall preferably includes a threaded stud 58, a washer 60, and a nut 62. Threaded stud 58 extends through spaced holes 64 in membrane 42. The rear portion 59 of threaded stud 58 is welded or otherwise suitably attached to the back of membrane 42. Threaded stud 58 extends forwardly to provide a guidepost for the installation of tiles 44.

Front surface 52 of tile 44 has a narrow through-hole 66 and a wider counter-bored hole 68 therein. This arrangement provides a passageway for threaded stud 58 and shoulders 70 for washer 60. Mechanical hardware 50 provides the primary holding force for attaching shielding tiles 44 to furnace wall. Although heat transfer bonding material 46 provides holding force for attaching shielding tiles 44 to furnace wall, it is secondary to mechanical hardware 50.

Perimeter surfaces 56 of shielding tiles 44 are generally planar with the exception of an arcuate recess 72 therein. Arcuate recesses 72 provide a holding surface for either heat transfer bonding material 46 or elongated compressible material 48, as described hereinafter.

Vertically and horizontally adjacent shielding tiles 44 are spaced apart a small distance. Many of these gaps are filled with heat transfer bonding material 46 to form a rigid joint. Arcuate recesses 72 help to hold heat transfer bonding material 46 therein before curing and permit a mechanical lock to be formed upon curing.

Elongated compressible material 48 is located between horizontally and vertically adjacent shielding tiles 44 at appropriate intervals in lieu of the rigid joints. As shown in FIG. 6, heat transfer bonding material 46 need not extend into the area between adjacent shielding tiles 44 which include elongated compressible material 48, thus making these areas substantially void of material which is not compressible. Elongated compressible material 48 fits within arcuate recesses 72 of adjacent tiles 44. This makes protective wall structure 38 particularly advantageous over prior art protective wall structures because elongated compressible material 48 acts as an expansion joint. The expansion joints permit shielding tiles 44 to expand due to the thermal expansion which occurs when the furnace is brought up on line after being taken down for an outage without cracking and falling off the wall. It is important that elongated compressible material 48 can expand and contract and resist the temperatures and chemicals inside combustion zone 14.

Shielding tiles 44 of the present invention are preferably made from a refractory material comprising silicon carbide. The tiles should also exhibit high resistance to spalling as well as good abrasion resistance with a usable service temperature of at least 1000° C. Further, the tiles should permit increased heat transfer. A particularly preferred refractory material meeting all these requirements is CARBOFRAX ® Mix M2091-7 which is commercially available from CARBORUNDUM ®.

Figure 1:
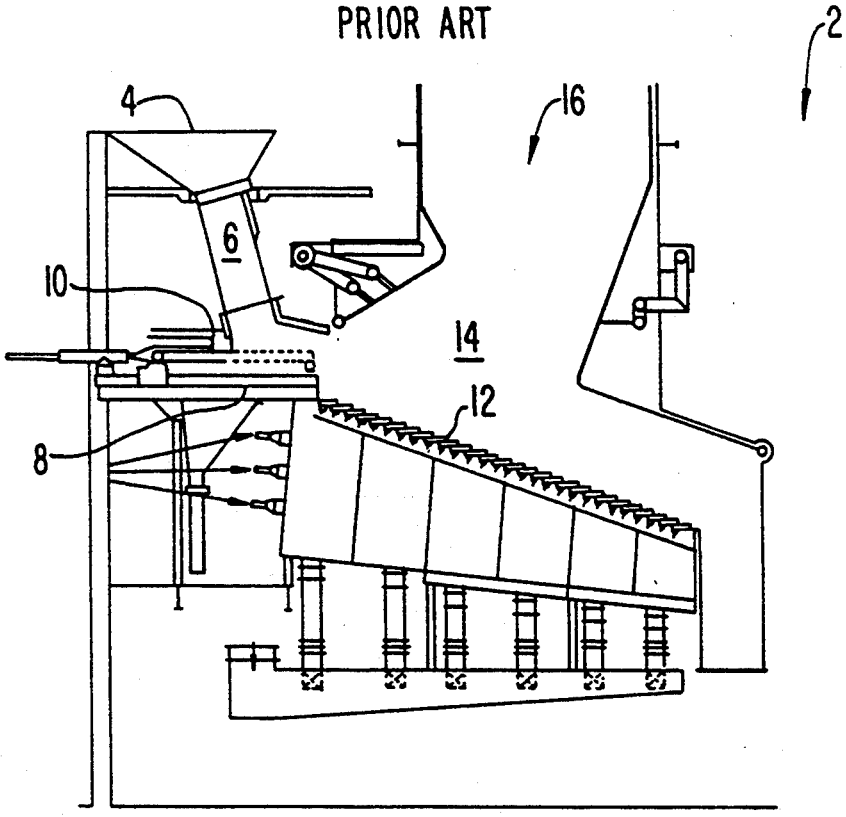
FIG. 1 PRIOR ART
FIG. 1 depicts a vertical cross section of a typical prior art refuse-to-energy plant.
Figure 2:
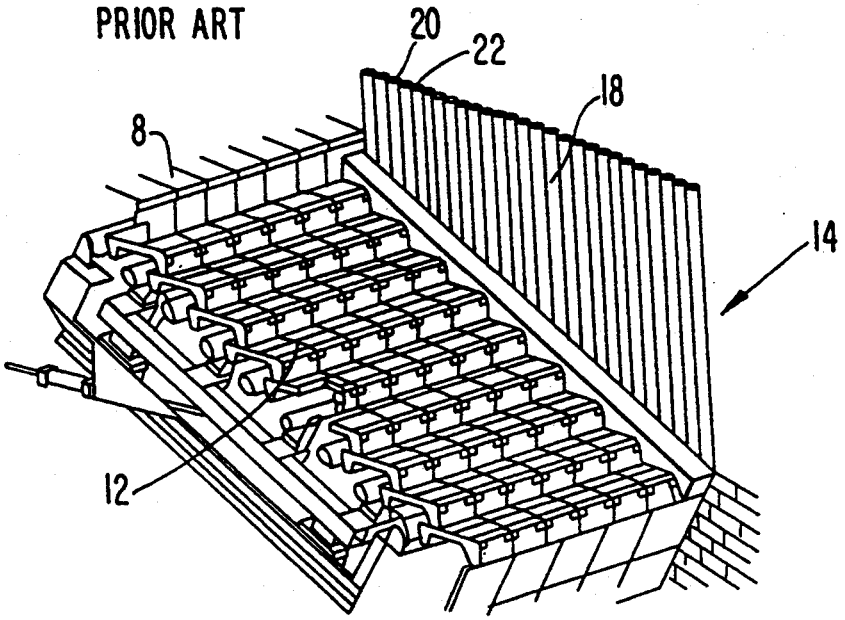
FIG. 2 PRIOR ART
FIG. 2 illustrates a perspective view of the lower portion of the prior art refuse-to-energy plant of FIG. 1.
Figure 3:
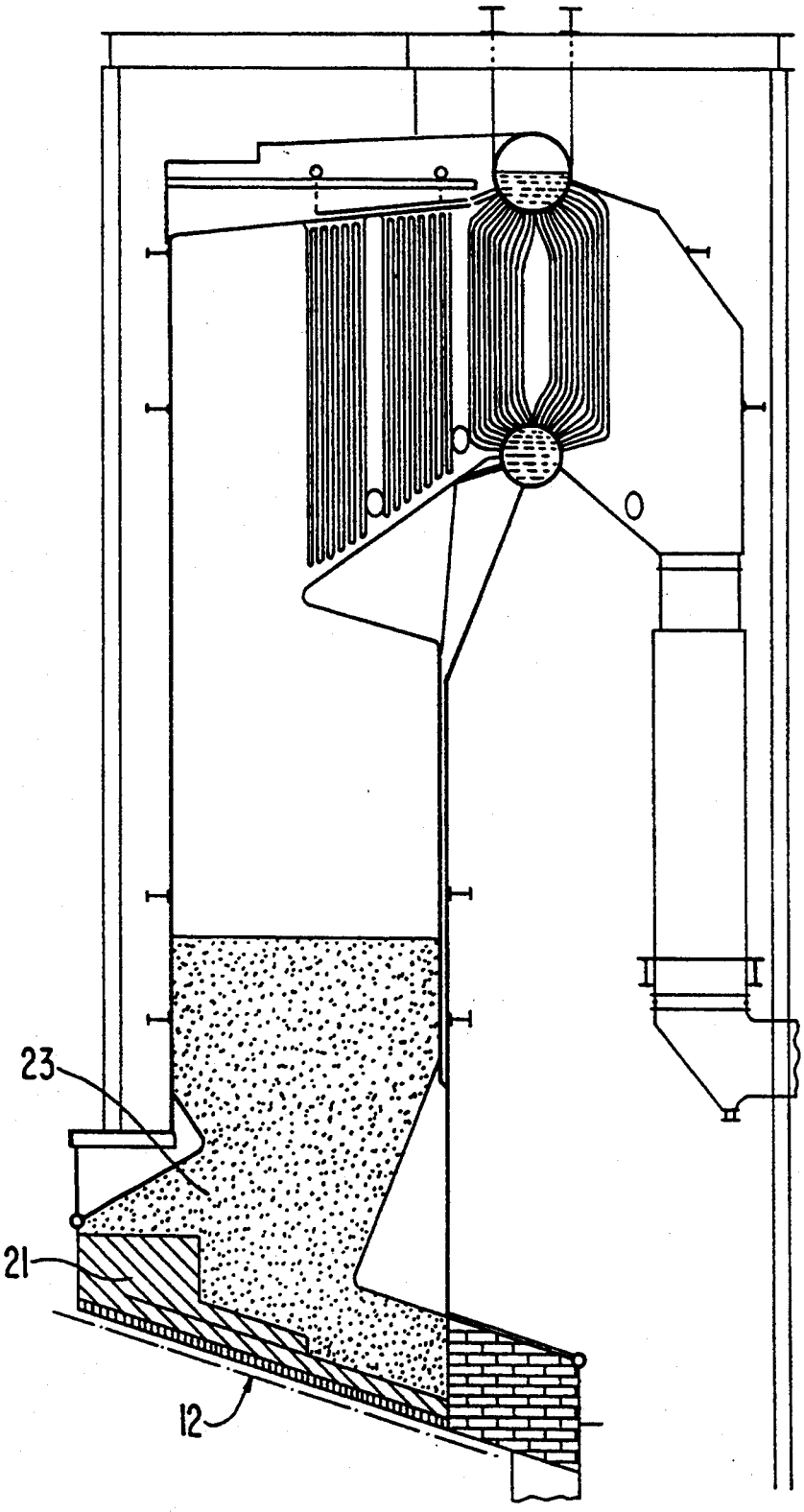
FIG. 3 PRIOR ART
FIG. 3 illustrates a vertical cross section showing a sidewall of the prior art refuse-to-energy plant of FIG. 1.
Figure 4:
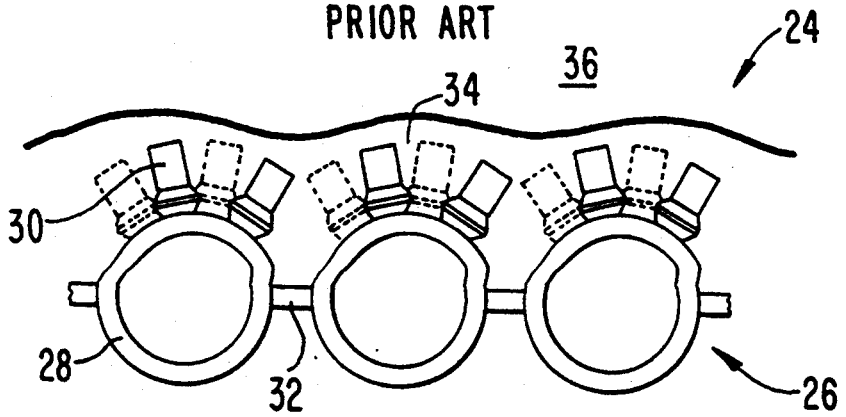
FIG. 4 PRIOR ART
FIG. 4 is top sectional view of a prior art furnace wall and protective structure.

Heat transfer bonding material 46 is most preferably a silicon carbide mortar. The preferred silicon carbide mortar and the castible refractory of the FIG. 4 protective wall structure have similar ingredients. However, the silicon carbide mortar is a much finer grade. The silicon carbide mortar helps provide a good mechanical bond between the shielding tiles and the boiler tubes and is a good thermal conductor. A particularly preferred silicon carbide mortar which satisfies these requirements is CARBOFRAX ® 8-XXF which is commercially available from CARBORUNDUM ®.

Elongated compressible material 48 is most preferably a rope made from a ceramic glass fiber which can expand and contract and resist the temperatures and chemicals inside combustion zone 14. A preferred product is FIBERFRAX ® which is commercially available from CARBORUNDUM ®.

While the specific products for the tiles, mortar, and compressible material above are preferred, one in the art will appreciate that other suitable materials may be used.

To install protective wall structure 38, holes 64 are drilled through membranes 42. A threaded studs 58 are inserted into holes 64 and are welded or suitably fixed to project horizontally from membranes 42 toward the furnace interior. A thin layer of mortar 46 is applied to either the inside surface of furnace wall or to the rear surface 54 of shielding tiles 44. Shielding tiles 44 are placed onto stud 58 through hole 66. Depending upon the location of the shielding tile 44, either rope 48 or mortar 46 is placed between the perimeter of the tile and its adjacent tiles. A washer 60 is placed over threaded stud 58 and a nut 62 is tightened on threaded stud to affix shielding tile 44 to wall. The tightening of nut 62 also assures that mortar 46 fills the gaps between tiles 44 and the furnace wall. A cap, schematically indicated by reference numeral 74, is then placed in hole 68 on top of nut 62 to protect nut 62, washer 60, and threaded bolt 58 from the gases and flames in the combustion zone. While, cap 74 is preferably a CARBOFRAX ® cap manufactured by CARBORUNDUM ®, other materials and products may be used to protect these elements.

Figure 8:
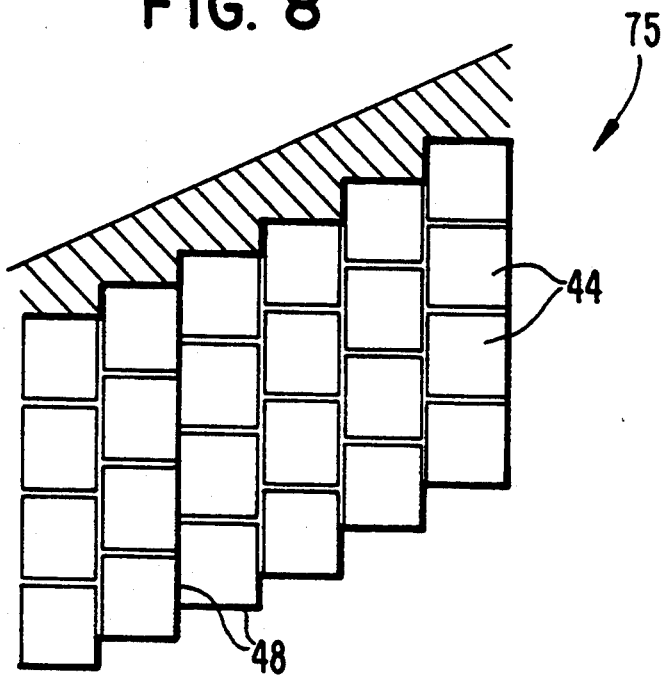
FIG. 8 shows an elevational view of a furnace wall section of the present invention with the shielding tile of adjacent rows in a vertically offset configuration.
Figure 7:
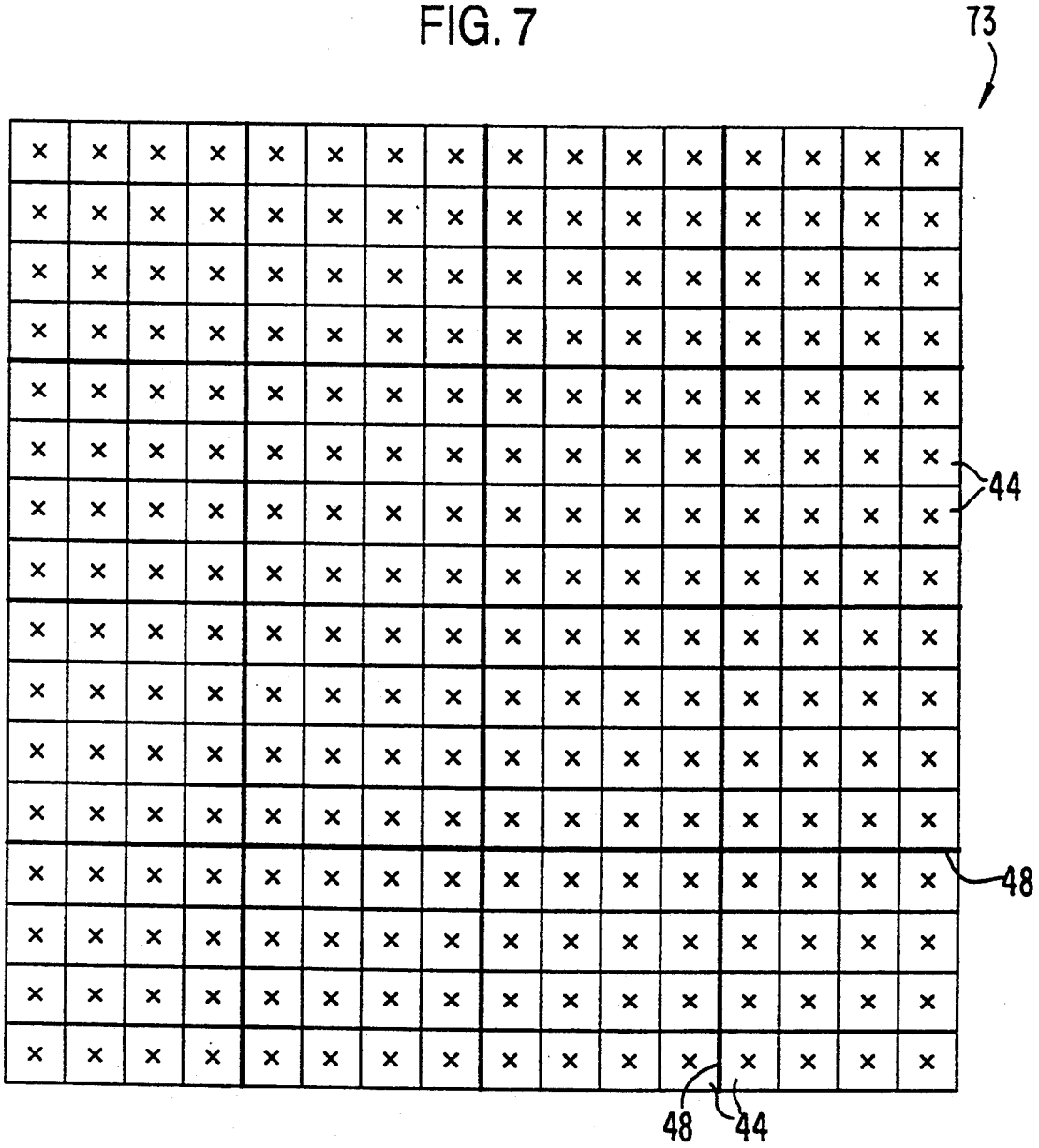
FIG. 7 shows an elevation view of a furnace wall area of the present invention with the shielding tiles of adjacent rows in an aligned relationship.

The expansion joint can be effective with shielding tiles having an aligned row configuration 73, as shown in FIG. 7, or with shielding tiles having a vertically offset row configuration 75, as shown in FIG. 8. In both configurations, elongated compressible material 48 is preferably placed between every four rows and every four columns of shielding tiles 44. The spaces between the remaining adjacent shielding tile interfaces are filled with mortar 46. While the preferred embodiment is to place the expansion joints, e.g., compressible material 48, around the perimeter of four-by-four sub-array groups of shielding tiles 44, one in the art would appreciate that the size of the sub-arrays need not be four-by-four, as long as the spacing of the expansion joints is sufficient to prevent tiles 44 from cracking due to thermal expansion.

When pipes 40 are located on three inch centers, tiles 44 are preferably 5¾-inch squares with gaps of approximates ¼-inch between tiles 44 when cool. With elements of this size, it is preferred to use a rope of ½-inch diameter for the elongated compressible material.

Figure 9:
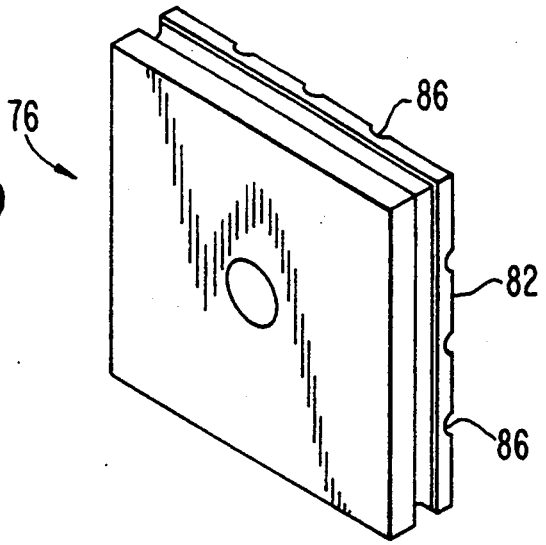
FIG. 9 depicts an alternative embodiment of a shielding tile for protecting a wall with boiler robes having pin studs thereon.
Figure 10:
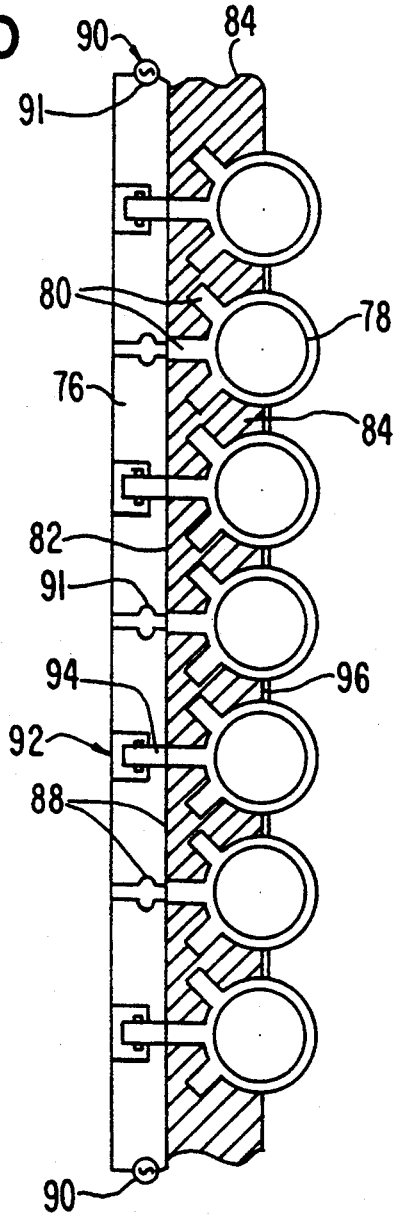
FIG. 10 shows a top sectional view of the furnace wall and protective structure for a wall with boiler robes having pin studs thereon.
Figure 11:
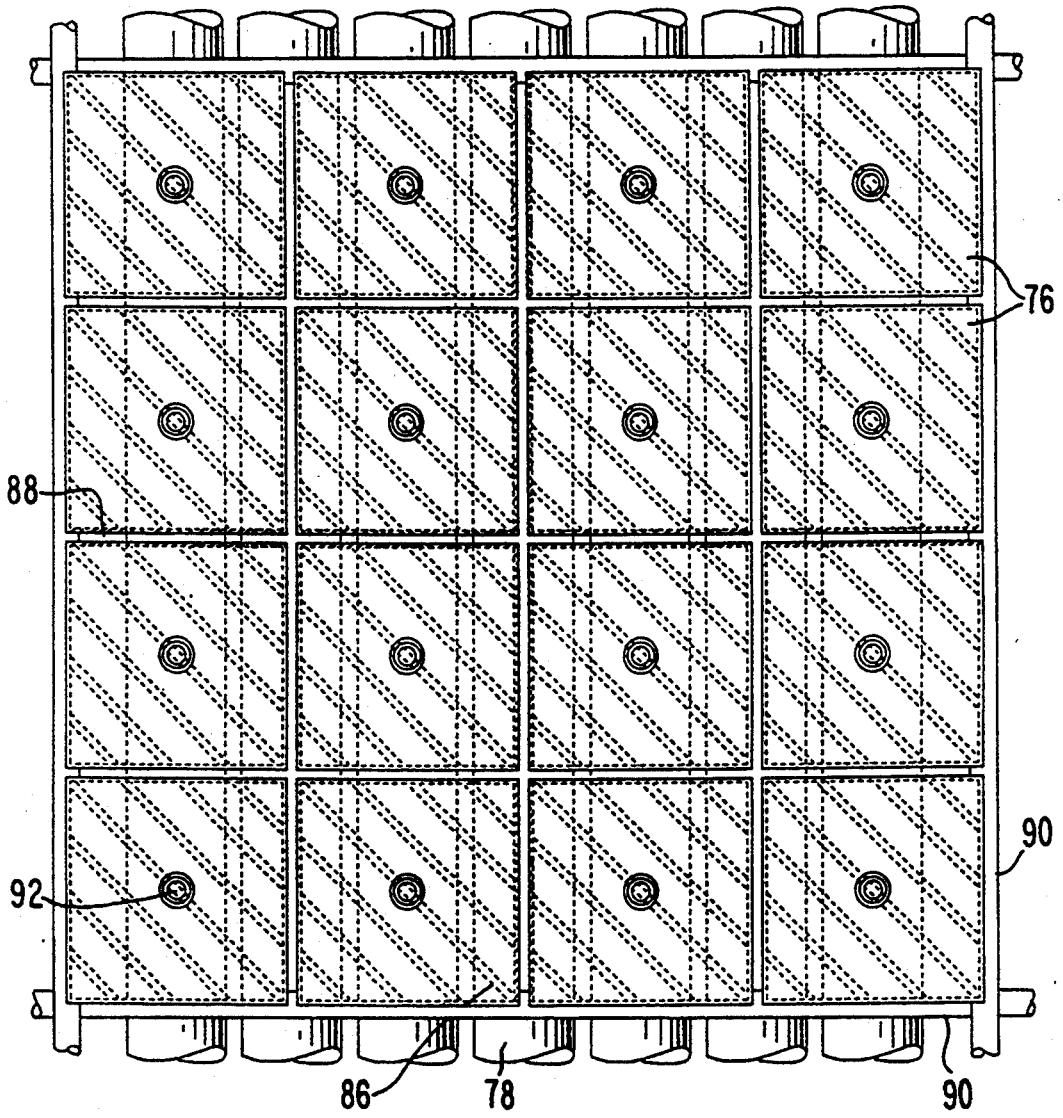
FIG. 11 is an elevational view of a furnace wall section and protective structure for a wall with boiler robes having pin studs thereon.

As depicted in FIGS. 9–11, a slightly different shielding tile 76 is used for the purpose of protecting boiler tubes 78 having pin studs 80. Such an embodiment is particularly advantageous in replacing existing protective wall sections. As shown in FIGS. 9 and 10, rear surface 82 of shielding tile 76 is generally planar and interfaces with castible refractory 84. Therefore, rear surface 82 need not be contoured match the shape of the furnace wall. Shielding tiles 76 preferably include diagonally oriented recessed grooves 86 which act as gripping surfaces to increase the mechanical bond between tiles 76 and furnace wall when grooves 86 are filled with heat transfer bonding material 88, e.g., mortar.

Similar to the embodiment shown in FIGS. 5 and 6, elongated compressible material 90 is placed between arcuate recesses 91 of adjacent vertical and horizontal shielding tiles 76 at appropriate intervals to provide an expansion joint. Shielding tiles 76 would also be structurally coupled to furnace wall by mounting hardware 92 which includes a threaded stud 94. However, installation of shielding tile 76 differs in that threaded stud 94 is preferably handwelded onto a pin stud 80 instead of membrane 96. Attaching threaded stud 94 to pin stud 80 facilitates installation because of the location pre-existing castible refractory 84.

It is to be understood that the disclosed embodiments are merely illustrative of the principles of the present invention which could be implemented by other types of structures which would be readily apparent to those skilled in the art. For example, although the furnace tile and expansion joint arrangement is illustrated and described as being located on a sidewall of a refuse-to-energy facility, one in this art would appreciate that the arrangement of the present invention can be used on other walls of a refuse-to-energy facility or can be used in other types of steam generating facilities which do not convert refuse to energy. Accordingly, the scope of the present invention is to be determined in accordance with the appended claims.

What is claimed is:

1. A shielding arrangement for protecting boiler tubes from an interior combustion zone in a steam generating unit, the shielding arrangement comprising:

an array of shielding tiles, said shielding tiles having a first surface facing the interior combustion zone, a second surface facing the boiler tubes, and a plurality of sidewall surfaces;

heat transfer bonding material positioned between the boiler tubes and said second surfaces of said shielding tiles; and elongated compressible material positioned between sidewall surfaces of adjacent shielding tiles for permitting relative expansion between said adjacent shielding tiles due to an increase in temperature in the combustion zone.

2. The boiler tube shielding arrangement of claim 1, wherein said elongated compressible material is a rope comprised of a fiber material.

3. The boiler tube shielding arrangement of claim 2, wherein the fiber material is a ceramic glass fiber.

4. The boiler tube shielding arrangement of claim 1, wherein the sidewall surfaces of the shielding tiles include recesses and said elongated compressible material being positioned between the recesses of adjacent shielding tile sidewall surfaces.

5. The boiler tube shielding arrangement of claim 4, wherein the boiler tubes include pin studs facing the second surfaces of the shielding tiles and the second surfaces of the shielding tiles being contoured for mechanically bonding the shielding tiles to the heat transfer bonding material.

6. The boiler tube arrangement of claim 5, wherein the contoured second surfaces of the shielding tiles includes a plurality of spaced concave grooves for retaining said heat transfer bonding material.

7. The boiler tube shielding arrangement of claim 4, wherein the boiler tubes have a circumference portion without pin stud protrusions and said second surfaces of the shielding tiles being contoured to generally match the circumference portion of the boiler tubes.

8. The boiler tube shielding arrangement of claim 1, wherein said array of shielding tiles includes of a plurality of sub-array sections of shielding tiles, each said sub-array section having a perimeter defined by sidewall surfaces of shielding tiles within the sub-array section, wherein said elongated compressible material being positioned around said perimeter of said sub-array sections.

9. The boiler tube shielding arrangement of claim 8, wherein said sub-array sections of shielding tiles comprise sixteen shielding tiles.

10. The boiler tube shielding arrangement of claim 8, wherein the perimeters of said sub-array sections of shielding tiles are rectangular shaped.

11. The boiler tube shielding arrangement of claim 8, wherein the perimeters of said sub-array sections of shielding tiles include four sides, wherein two sides of said four sides being generally straight and the other two sides of said four sides having a number of stepped sections.

12. The boiler tube shielding arrangement of claim 1, wherein the area between said sidewall surfaces of adjacent shielding tiles is substantially void of non-compressible material.

* * * * *